United States Patent [19]

Cho

[11] 4,105,203

[45] Aug. 8, 1978

[54] TENNIS TRAINER

[76] Inventor: Tae Han Cho, 19010 Quail Valley Blvd., Gaithersburg, Md. 20760

[21] Appl. No.: 758,396

[22] Filed: Jan. 11, 1977

[51] Int. Cl.[2] ..... A63B 69/38

[52] U.S. Cl. ..... 273/29 A

[58] Field of Search ..... 273/26 E, 26 R, 29 A, 273/95 A, 185 D, 185 C, 200 B, 200 A, 200 R, 58 C, 58 D, 197 R, 197 A, 184 B, 199 R, 199 A, 55 R

[56] References Cited

U.S. PATENT DOCUMENTS

| | | | |
|---|---|---|---|
| 2,506,825 | 5/1950 | Carlson | 273/95 A |
| 2,818,255 | 12/1957 | Ponza | 273/26 E |
| 3,341,200 | 9/1967 | Brandley | 273/26 E |
| 4,022,476 | 5/1977 | Barton | 273/58 C |

FOREIGN PATENT DOCUMENTS

| | | | |
|---|---|---|---|
| 276,812 | 9/1927 | United Kingdom | 273/197 R |

*Primary Examiner*—Richard C. Pinkham
*Assistant Examiner*—T. Brown
*Attorney, Agent, or Firm*—Rose & Edell

[57] ABSTRACT

A tennis trainer includes a generally L-shaped arm having a ball holder at one end and pivotally engaged to a support at the other. Impact against the ball in a direction axially along the ball-supporting section of the arm is initially absorbed by a resilient section of the other section of the arm. A housing on the support includes a slot through which the arm extends and a rotatable cylinder to which the arm is secured. Bias springs oppose rotation of the cylinder and hence the arm. The housing is mountable upside down to permit the trainer to be used for back hand practice or for left handed fore hand practice. Various bending of the arm and vertical positioning of the support permits the ball to be positioned at various heights and positions.

7 Claims, 10 Drawing Figures

FIG.7
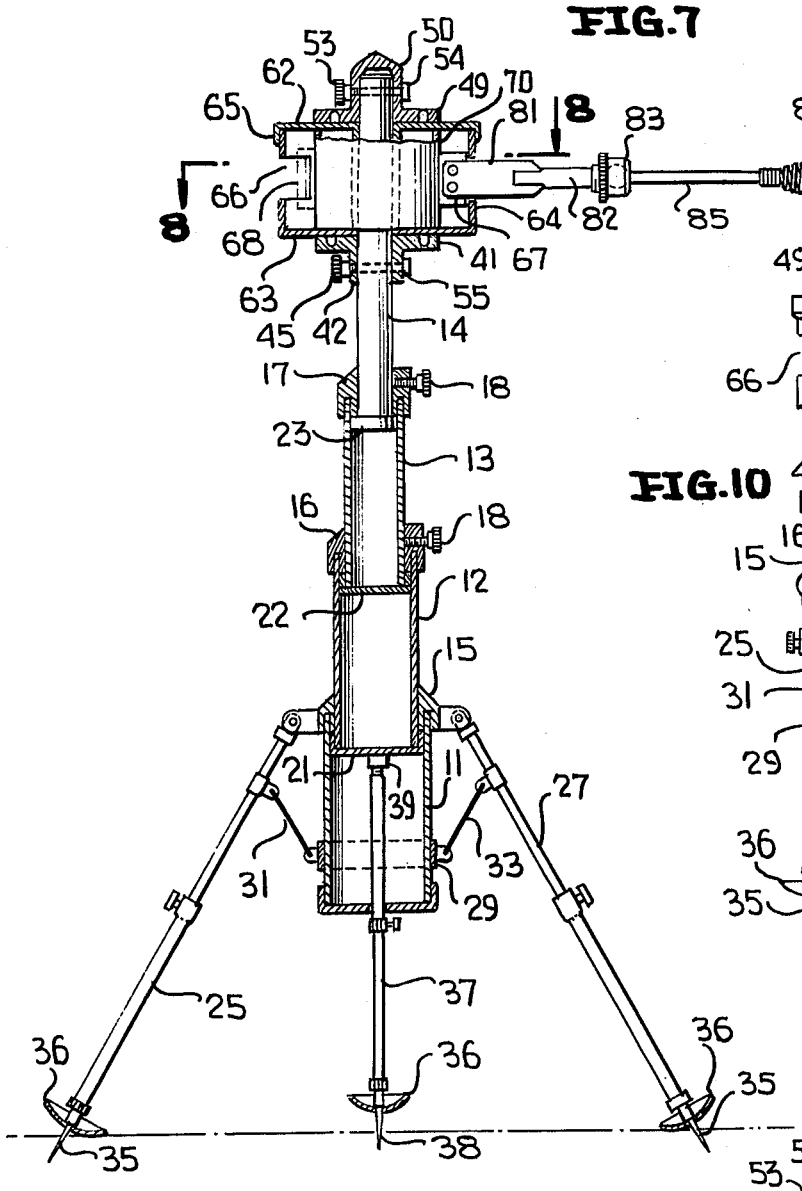
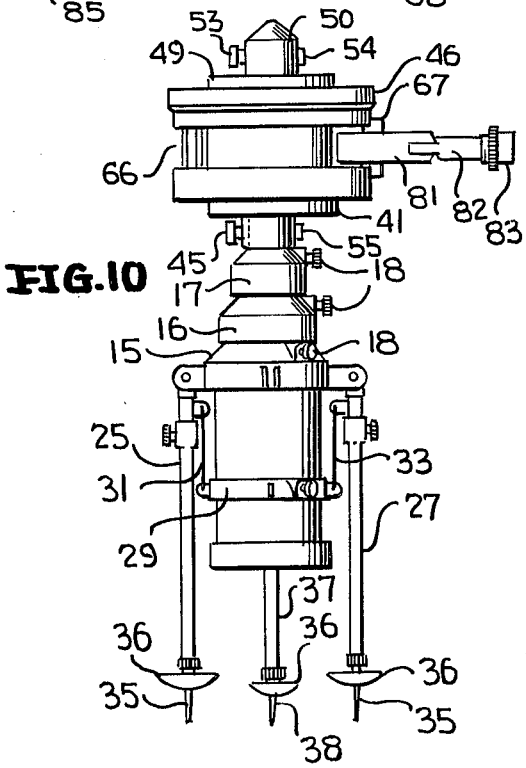
FIG.10
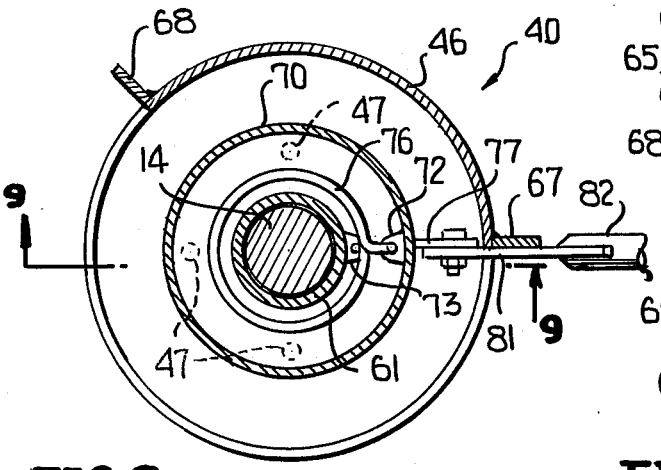
FIG.8
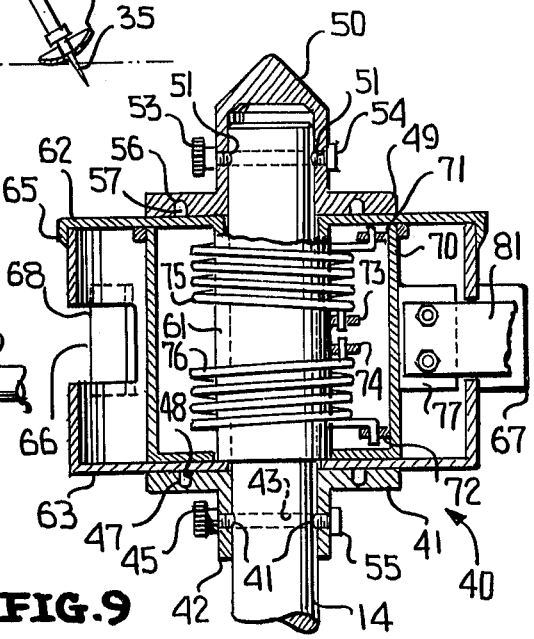
FIG.9

TENNIS TRAINER

BACKGROUND OF THE INVENTION

The present invention relates to tennis training devices in general and, more specifically to improvements in such devices which offer the advantages of versatility, portability and realistic response.

Prior art tennis training or practice devices have suffered from various combinations of the following disadvantages: high cost; lack of mobility; lack of versatility; unrealistic response; complex construction; time consuming to set-up or install. An example of such prior devices is the automatic ball feeder which propels tennis balls toward the player. Such ball feeders are often costly, quite heavy, and require a large area such as a tennis court for use. Simpler tennis practice devices are of the suspended-ball type. For example, tethered ball devices have been proposed as tennis trainers; however, a tethered ball device offers no resistance to a racket impacting the ball and is therefore unrealistic as a training device. Further, such tether devices result in erratic movement of the ball so that for all practical purposes they can only be used when the ball is still.

SUMMARY OF THE INVENTION

In accordance with the present invention, a tennis training device is provided which incorporates the advantages and eliminates the disadvantages of both the automatic ball feeder and the tethered ball device. A vertical support member includes a plurality of telescoping tubular members and is supported on legs of adjustable length. A cylindrical spring box is mounted on the support and has an arcuate slot through which a rigid arm extends in a plane which is nominally horizontal. The arm bends at substantially 90° in the said plane and holds a tennis ball at its remote end. The rigidity of the arm is broken by a tightly wound helical spring arranged to absorb the initial impact of the ball by a tennis racket. Within the spring box the arm is secured to a movable cylinder which is rotatable about a vertical axis but is spring-biased to urge the arm against a first stop member defining one end of the spring box slot. A second stop member defines the other end of the slot to limit movement of the arm. When the ball is struck, the arm and the movable cylinder rotate about the aforesaid vertical axis until the arm reaches second stop member or the spring-bias force overcomes the momentum of the ball and arm; the arm is then returned to its rest position.

The arm is rotatable to subtend different angles and thereby permit a variety of strokes to be practiced. In addition, the spring box can be placed in an upside-down position, whereby the user may practice back hand or left hand strokes.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein:

FIG. 7 is a view in section taken along lines 7 — 7 of FIG. 1;

FIG. 8 is a view in section taken along lines 8 — 8 of FIG. 7;

FIG. 9 is a view in section taken along lines 9 — 9 of FIG. 8; and FIG. 10 is a view in plan of the device with the arm removed and the legs and support member collapsed for when the device is not in use.

DESCRIPTION OF PREFERRED EMBODIMENTS

Figure 1:
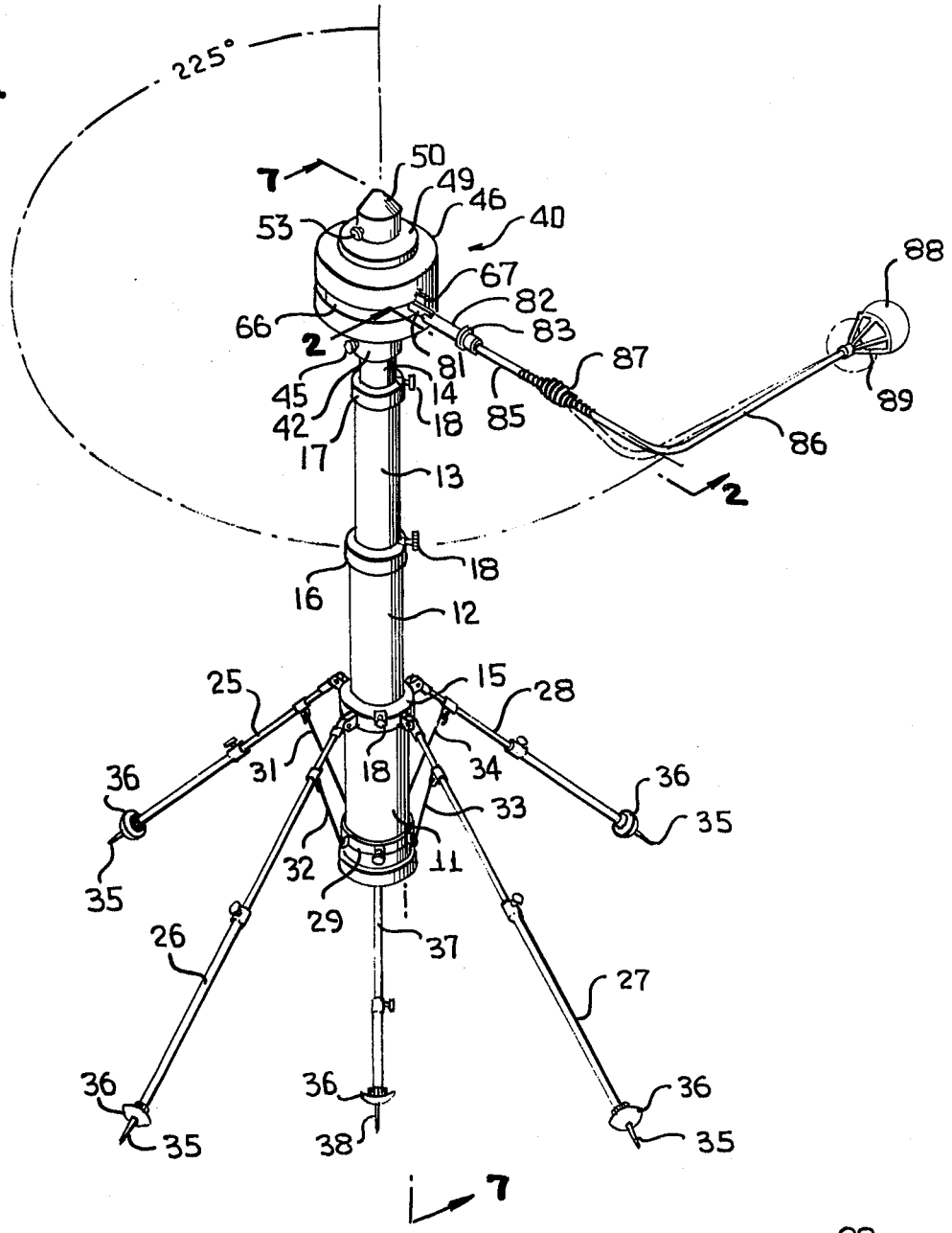
FIG. 1 is a view in perspective of the preferred embodiment of the present invention.
Figure 2:
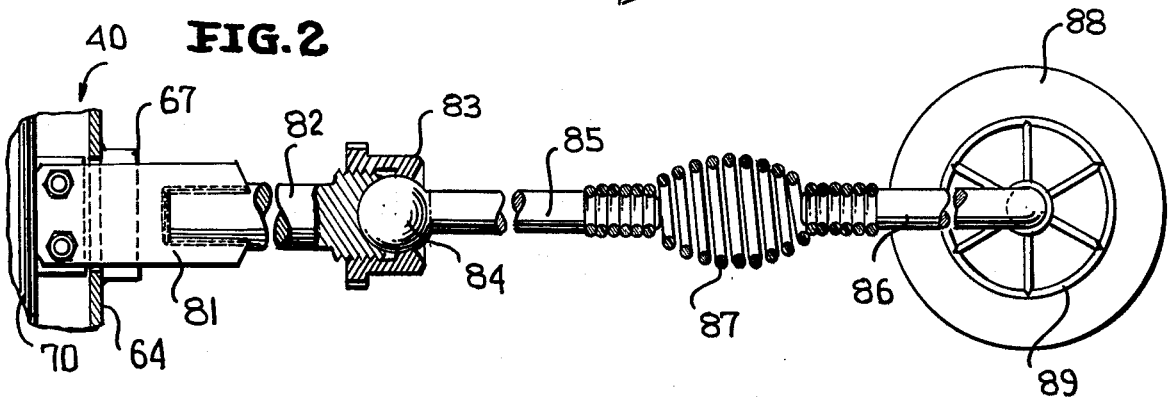
FIG. 2 is a view in section through lines 2 — 2 of FIG. 1.

Referring more specifically to the drawings, a tennis training device includes a vertical support in the form of four telescopically-related tubular members 11, 12, 13 and 14 (referenced from bottom to top), with member 11 having the largest diameter and member 14 the smallest. The tubular members are arranged with their longitudinal axes co-extending vertically when the device is in use as shown in FIGS. 1 and 7. Annular collars 15, 16 and 17 define the upper ends of tubular members 11, 12 and 13, respectively, and surround the next higher tubular member in slidable engagement. Each collar has a thumbscrew 18 extending radially therethrough for purposes of securing the positions of the tubular members at various heights. Flanges 21, 22 and 23 define the lower ends of tubular members 12, 13 and 14, respectively, and are of sufficiently large diameter relative to collars 15, 16 and 17, to prevent full disengagement of the tubular members.

Four leg members 25, 26, 27 and 28, are pivotally engaged to collar 15 at four spaced locations about the collar. Each leg is adjustable in length by virtue of its having two telescopically engaged sections which can be secured at various positions of extension. A ring 29 surrounds tubular member 11 and is slidable to various heights along that member. Four rods 31, 32, 33 and 34 are pivotally engaged to ring 29 at four spaced locations about the ring. The opposite ends of rods 31, 32, 33 and 34 slidably engage respective leg members 25, 26, 27 and 28. By this arrangement, the vertical position of ring 29 along tubular member 11 determines the angle made by legs 25, 26, 27 and 28 relative to the vertical axis of the tubular members; that is, the higher the position of ring 29, the more the legs are spread out. Each of legs 25, 26, 27 and 28 terminates in a spike 35 which can be stuck into the ground. A flange 36 surrounds each spike 35 and facilitates insertion of the spike into the ground as well as serving as a stop to prevent the spike from being inserted too far. A fifth leg 37 extends downwardly through the bottom of tubular member 11 along the central longitudinal axis of the tubular member. The protruding end of leg 37 terminates in a spike 38, whereas the other end of leg 37 threadedly engages a collar 39 provided on the underside of flange 21. Leg 37 has two telescopically engaged members which can be extended as desired.

A spring box structure 40 is secured to the top of tubular member 14. The spring box structure includes a support bracket 41 having a depending cylindrical collar 42 which surrounds the upper tubular member 14. Suitably provided diametrically spaced holes 43 in tube 14 are aligned with similarly spaced holes 44 in collar 42 to permit a thumbscrew 45 and nut 55 to secure flange 41 to tubular member 14. A cylindrical housing 46 rests on the annular upper surface of flange 41 with its longitudinal axis co-extensive with that of tubular member 14. Four ninety degree spaced holes 47 in the upper flange surface are adapted to receive four respective detent pins 48, which project downward from the bottom surface of housing 46, to prevent rotational movement of housing 46. An annular cover flange includes a cylindrical collar 50 projecting upwardly to cover the upper end of tubular member 14. Two diametrically spaced holes 51 in collar 50 mate with similarly spaced holes 52 in tubular member 14 to permit thumbscrew 53 and nut 54 to secure the cover flange 50 to tubular member 14 so that the annular under surface of flange 49 rests on the upper annular surface of housing 46. Four ninety degree spaced holes 56 in the bottom surface of flange 49 are adapted to receive respective detent pins 57 projecting upwardly from the top of housing 46 to preclude further rotational movement of the housing. As will be described in more detail below, housing 46 may be positioned upside down on tubular member 14, whereby pins 57 project downwardly into holes 47 of flange 41 and pins 48 project upwardly into holes 56 of flange 49.

Housing 46 is constructed as a hollow annular member arranged with its inner annular wall 61 surrounding and in contact with tubular member 14. In order to facilitate construction, the housing 46 is constructed of two members: a first member including inner wall 61 in the form of a collar depending from a horizontal annular section annular plate 62; and a second member comprising an annular plate 63 from which the outer wall 64 of the housing projects upwardly. The outer rim 65 of flange 62 is bent downward to overlap the upper portion of outer wall 64, the two housing members being secured together in the area of the overlap by a suitable adhesive, welding, or the like. An arcuate slot 66 is defined in outer wall 64 and extends for approximately 225° around the housing. A first stop member 67, in the form of a projection extending radially outward, emanates from one end of slot 66. A second stop member 68 projects similarly from the other end of the slot.

An annular ridge 69 projects downwardly into the housing interior from the bottom surface of flange 62. Ridge 69 serves as a guide for a rotatable hollow cylinder 70 which is disposed concentrically with respect to housing 46 and has an outer diameter substantially equal to the inner diameter of ridge 69. Cylinder 70 is open at its top and has a central hole in its bottom end to permit the cylinder to rotate tubular member 14. Small tab-like members 71 and 72 project radially inwardly from locations proximate the top and bottom, respectively, of cylinder 70. Similar tab-like members 73 and 74 project radially outwardly from the interior wall of housing 46 at locations which are closer to the longitudinal center of housing 46 than are tabs 71 and 72. A first cylindrical helia spring 75 has its ends secured to tabs 71 and 73 and is wrapped around inner wall 61 of housing 46. A second such spring 76 is secured at its ends to tabs 72 and 74 and is similarly wrapped about wall 61. Springs 75 and 76 apply a torsional force between fixed wall 61 and rotatable cylinder 70 to bias cylinder 70 against rotation relative to wall 61.

A flat flange 77 which is either integral with or otherwise secured to cylinder 70, projects radially outward from cylinder 70 toward the outer wall 64 of housing 46. Flange 77 is longitudially positioned in alignment with slot 66. An arm member, generally designated by the reference numeral 80, projects radially outward from flange 77, through slot 66, to the exterior of housing 46. Arm 80 includes a holding plate 81 which is secured at one end to flange 77 by screws and nuts or some equivalent securing means. Holding plate 81 extends through slot 66 and has a rigid rod or cable 82 secured to its exposed other end. The other end of rod 82 is externally threaded to engage the internal threading of a generally cup-shaped coupling member 83. The opposite end of coupling member is open and contoured to retain a ball 84 in a ball and socket relation. The end of rod 82 which projects into the cup is suitably contoured to match ball 84 whereby, upon tightening of the threaded engagement, the ball 84 is held firmly in place by the cable 82 and coupling member 83.

A further rigid rod or cable 85 is secured to ball 84 and extends outwardly from the ball through the end of coupling member 83 which is opposite rod 82. An L-shaped further rod 86 has one leg longitudinally aligned with but spaced from rod 85. The two rods 85 and 86 are joined by a relatively rigid helical spring 87 which is securely wound about the opposed ends of rods 85 and 86. The other leg of the L-shaped rod 86 extends horizontally and terminates in a conical cup-like member 89 adapted to hold a tennis ball 88 which is force-fitted partially into the cup and is centrally positioned with respect to rod 86.

When not in use the unit appears as shown in FIG. 10. As illustrated therein, tubular members 11, 12, 13 and 14 are fully retracted into one another, legs 25, 26, 27 and 28 are fully retracted, ring 29 is positioned to permit collapse of the legs to a vertical position, and leg 37 is fully retracted. In addition, coupling member 83 may be loosened and removed from engagement with rod 82 so that ball-hold part of arm 80 may be separately stored.

Figure 3:
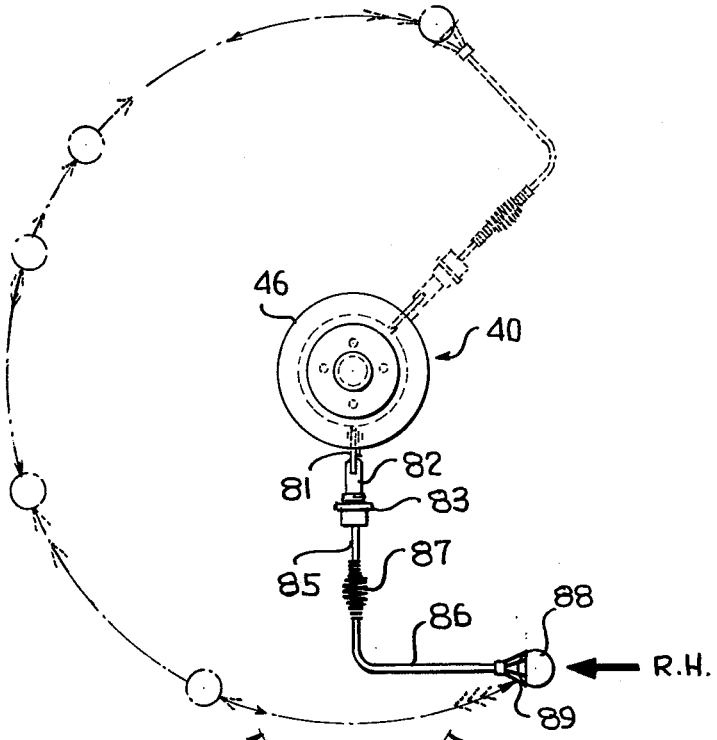
FIG. 3 is a top view in plan of the spring box and arm portions of the device and which diagrammatically illustrates use of the invention by a right-handed player.

In order to deploy the unit for use, as fully shown in FIGS. 1 and 7, legs 25, 26, 27, 28 and 37 are extended to the desired length and are spread to the desired extent; thereafter spike 35, 38 are stuck into the ground. If the unit is to be used on a hard surface, or indoors, the spikes may be threadedly disengaged from the legs. Tubular members are then telescopically extended to the desired height. The arm 80 is put together, it being noted that the rod sections may be positioned over a range of angles relative to horizontal by appropriately rotating ball 84 within coupling member 83 and then tightening the threaded connection between rod 82 and coupling member 83. With the device thus adjusted to provide the ball at the desired height, the player may stroke the ball in a manner which causes arm 80 to rotate clockwise as seen in FIGS. 1 and 3. This stroke may be a forehand stroke by a right-handed player or a backhand stroke by a left-handed player. The initial impact of the racket against the ball is partially absorbed by the qxial bending of spring 87. The ball and arm are driven by the stroke about an arc defined by slot 66. Depending upon the force of the stroke, the arm 80 may be driven through the entire slot length or through only a part of the slot. In either case, rotation of arm 80 causes cylinder 70 to rotate within the spring box 40 in opposition to the bias forces exerted by spring 75 and 76. If the stroke is sufficiently strong, the arm is driven through the entire slot 66 until it abuts stop member 68; a less powerful stroke results in the arm being stopped by springs 75 and 76 after traversing only part of the slot 66. In either case, after the arm is stopped the springs 75 and 76 force the arm back through the slot in the opposite direction. In the meantime, the player can position himself or herself in the proper stance to make ready for the returning tennis ball which can be stroked before or after the arm has been stopped by stop member 67.

Figure 4:
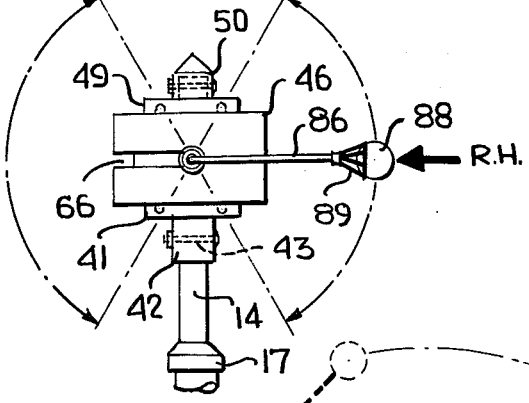
FIG. 4 is a front view in plan of the spring box and arm showing the rotation capability of the arm.

The player has many ways of adjusting the level of the ball to be stroked. Specifically, legs 25, 26, 27, 28 and 37 are adjustable in length; tubular members 11, 12, 13 and 14 are extendable; rod 85 may be rotated vertically at the coupling member 83; and the ball holding leg section of rod 86 may be rotated in a vertical plane by rotating rod 85 about own axis at coupling member 83. The latter adjustment is diagrammatically illustrated in FIG. 4 and is best used to properly position the ball for service strokes, ground strokes, top spin strokes, etc.

Figure 5:
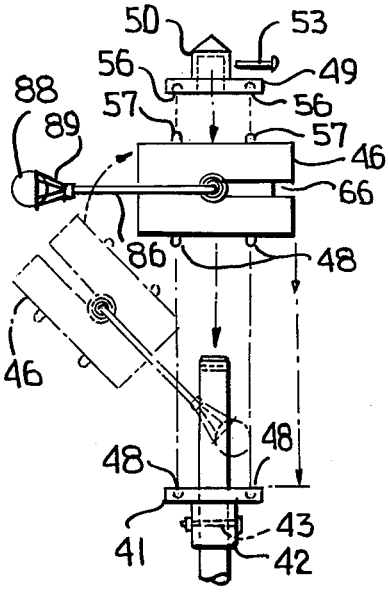
FIG. 5 is an exploded and partially diagrammatic view in plan of the spring and arm, showing the reversibility of the spring box on the vertical support to permit use by a left-handed player.
Figure 6:
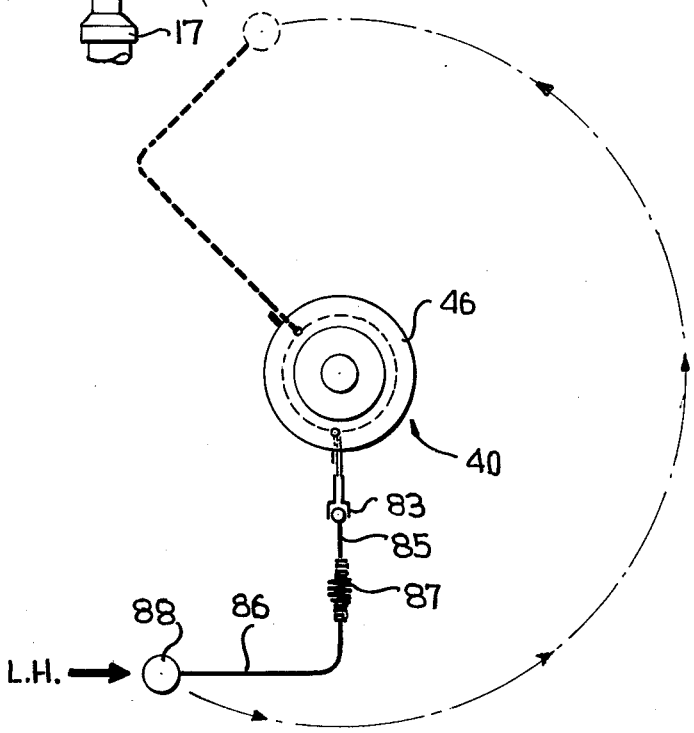
FIG. 6 is a view similar to that of FIG. 3 but wherein use by a left-handed player is illustrated diagrammatically.

As illustrated in FIG. 5, the spring box 40 may be turned upside down so that the ball can be properly positioned for left-handed forehand strokes or right-handed backhand strokes. This is done by loosening and removing screw 53, lifting upper flange 49 off tubular member 14, removing the spring box 40 from tubular member 14, turning it upside down, and then placing it back on member 14. Upper flange 49 is then secured back in place and the unit is ready for use as illustrated in FIG. 6.

The device may be made lightweight by using polyvinylchloride for the tubular members, aluminum for the legs, and steel for the rods in arm 80. Of course, other materials may be used. It should also be noted that the ball (84) and socket (83) arrangement could be modified to have a notched detenting arrangement which provides discrete positions rather than a continuous range of positions of the arm 80.

The device described herein is extremely versatile by virtue of the wide range of positions of the ball for strokes by either left or right handed players. Moreover, the device is very realistic in that the resistance to strokes provided by springs 87, 75 and 76 simulates the force of a return shot. The player can hit the ball when the ball is still or moving back toward the player. Further, by rotating the arm 80 up or down slightly at coupler 83, the player can practice returning low or high shots using slightly upward or downward strokes. The spring 87 realistically absorbs the impact in any event. Importantly, the player is not limited to practicing only level ground strokes.

In addition, the device collapses into a compact unit which can be deployed for use in a minute or so. It can be used both indoors and outdoors.

While I have described and illustrated one specific embodiment of my invention, it will be clear that variations of the details of construction which are specifically illustrated and described may be resorted to without departing from the true spirit and scope of the invention as defined in the appended claims.

I claim:

1. Tennis training apparatus comprising:

a free-standing support structure having a vertical axis;

an arm member having first and second sections forming a generally L-shaped structure;

pivotal engagement means securing an end of said first section inside said support structure to permit rotational movement of said arm member about said vertical axis;

bias means in said support structure for biasing said arm member to a rest position and opposing rotational movement of said arm member;

spring means located in said first section of said arm member for imparting axial resiliency to said first section;

holder means located at an end of said second section for firmly holding a tennis ball in a position which is substantially centered with respect to said second section of said arm member;

whereby impact against said tennis ball in a direction axially toward said second section of said arm member is initially partially absorbed by said spring means and then partially absorbed by said bias means;

wherein said pivotal engagement means includes:

a housing having outer side walls, a top wall and a bottom wall forming an enclosure, said outer side walls being positioned to surround said vertical axis and having a horizontally-extending slot defined therein;

a hollow cylinder positioned inside said housing and coaxial with said vertical axis, said hollow cylinder being positioned for rotational movement about said vertical axis; and means securing said one end of said first section of said arm member to said hollow cylinder such that said first section extends radially outward from said vertical axis through the slot in said outer side walls.

2. The apparatus according to claim 1 wherein said bias means comprises further spring means positioned inside said hollow cylinder and connected to said support structure and to said hollow cylinder for opposing rotational motion of said hollow cylinder about said vertical axis.

3. The apparatus according to claim 2 wherein said support structure comprises:

a plurality of telescopically related tubular members positioned coaxially about said vertical axis;

means for securing said tubular members over a wide range of extended and retracted positions to permit selective adjustment of the height of said support structure;

wherein said housing is secured to the uppermost of said tubular members with said hollow cylinder surrounding said uppermost tubular member; and wherein said further spring means comprises at least one helical spring wound about said uppermost tubular member and having one end secured to said uppermost tubular member and another end secured to said hollow cylinder.

4. The apparatus according to claim 3 wherein said support structure further comprises:

a plurality of selectively retractable legs mounted at their upper ends for pivotal movement in respective vertical planes;

a collar slidably mounted about the periphery of the lowermost tubular member;

means for selectively securing said collar at various positions along the length of said lowermost tubular member; and a plurality of rods, one for each of said retractable legs, each having one end pivotally secured to said collar for rotational movement in a vertical plane and having another end which slidably engages a respective retractable leg at adjustable positions along that leg.

5. The apparatus according to claim 3 wherein said outer side walls of said housing form an outer cylinder, said slot extending over an arcuate angle of at least 180° in said outer cylinder.

6. The apparatus according to claim 5 wherein said housing is removably secured to said uppermost tubular member and is adapted to be re-positioned upside down and secured to said uppermost tubular member.

7. The apparatus according to claim 1 wherein said housing is removably secured to said support structure and is adapted to be re-positioned upside down and secured to said support structure.

* * * * *